US012696980B2

(12) United States Patent
Chen

(10) Patent No.: US 12,696,980 B2
(45) Date of Patent: Aug. 4, 2026

(54) EASY-TO-TRANSPORT ASSEMBLED SOFA CHAIR

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 115 days.

(21) Appl. No.: 18/822,311

(22) Filed: Sep. 2, 2024

(65) Prior Publication Data

US 2026/0060427 A1 Mar. 5, 2026

(51) Int. Cl.
*A47C 4/03* (2006.01)

(52) U.S. Cl.
CPC ..... *A47C 4/03* (2013.01)

(58) Field of Classification Search
CPC ..... A47C 4/03
See application file for complete search history.

(56) References Cited

U.S. PATENT DOCUMENTS

| | | | | |
|---|---|---|---|---|
| 11,737,572 | B1 * | 8/2023 | Zhang | A47C 4/028 297/233 |
| 12,507,796 | B2 * | 12/2025 | Chen | A47B 13/003 |
| 2007/0108823 | A1 * | 5/2007 | Grabowski | A47C 13/005 297/354.1 |
| 2025/0143450 | A1 * | 5/2025 | Chen | A47B 13/003 |
| 2025/0380796 | A1 * | 12/2025 | Chen | A47B 13/02 |

FOREIGN PATENT DOCUMENTS

| | | |
|---|---|---|
| CN | 112920539 A | 6/2021 |
| CN | 216166436 U | 4/2022 |
| CN | 216256324 U | 4/2022 |

* cited by examiner

*Primary Examiner* — J. T. Newton
(74) *Attorney, Agent, or Firm* — Nitin Kaushik

(57) ABSTRACT

The present invention relates to the technical field of sofas, and in particular, to an easy-to-transport assembled sofa chair, including a chair seat, where handrail frames are respectively disposed on two sides of a body of the chair seat, a chair back is disposed between the handrail frames, and the chair back is located on a rear side of the chair seat; the chair back is formed by splicing two chair back plates, and the chair seat is formed by splicing two chair seat plates; and a support frame is added between the chair back and the chair seat, so that overall firmness of the sofa is enhanced. The chair seat and the chair back are split, so that a package size is reduced, thereby reducing transportation costs.

9 Claims, 10 Drawing Sheets

EASY-TO-TRANSPORT ASSEMBLED SOFA CHAIR

TECHNICAL FIELD

The present invention relates to the technical field of sofas, and in particular, to an easy-to-transport assembled sofa chair.

BACKGROUND

Sofas refer to a series of furniture disposed in an open or semi-open outdoor space in order to facilitate people's healthy, comfortable, and efficient public and private indoor and outdoor activities. The sofa is designed to make the outdoor activities easier and more pleasant and can provide a comfortable and free rest space for a user.

At present, a chair seat, a chair back and a handrail frame that are of a three-seat sofa on the market are detachable, but the chair seat and the chair back are integrally formed and non-detachable. An overall size of the chair seat and the chair back is large, and after an express package is paced, the package is large in volume, is inconvenient in transportation, and has high transportation costs. Therefore, a special transportation tool is needed for loading and transportation.

Therefore, the present applicant provides an easy-to-transport assembled sofa chair, to solve the problem proposed in the above background.

SUMMARY

A purpose of the present invention is to provide an easy-to-transport assembled sofa chair, to solve a problem that an existing large-size sofa is inconvenient to transport and has high costs during logistics transportation due to a large size and other problems.

To solve the above technical problems, the present invention provides an easy-to-transport assembled sofa chair, including a chair seat, where handrail frames are respectively disposed on two sides of a body of the chair seat, a chair back is disposed between the handrail frames, and the chair back is located on a rear side of the chair seat; and the chair back is formed by splicing two chair back plates, and the chair seat is formed by splicing two chair seat plates.

Further, a splicing side edge of the chair seat plate is provided with a bolt hole A, and the two chair seat plates are connected through a bolt and the bolt hole A; and frames are disposed around the chair seat plate, two side-by-side vertical beams are disposed on a region encircled by the frames, two ends of the vertical beam are welded to inner walls of the frames, a plurality of transverse plates are uniformly arranged on an upper surface of the vertical beam, and two ends of the transverse plate respectively abut against inner walls of the frames.

Further, two side edges of the chair seat are respectively provided with threaded holes C, and a rear portion of an upper surface of the chair seat and a middle portion of a lower surface of the chair seat are respectively provided with threaded holes E.

Further, a splicing side edge of the chair back plate is provided with a bolt hole B, and the two chair back plates are connected through a bolt and the bolt hole B.

Further, two side edges of the chair back are respectively provided with threaded holes D, and a bottom portion of the chair back is provided with a threaded hole E.

Further, a front leg and a rear leg are respectively welded at two ends of a lower surface of a handrail in a body of the handrail frame, and a cross bar is fixed between the front leg and the rear leg.

Further, a side edge of the cross bar is provided with a threaded hole C, and the cross bar is connected to a side edge of the chair seat through a bolt and the threaded hole C.

Further, an upper portion of a side edge of the rear leg is provided with a threaded hole D, and the rear leg is connected to a side edge of the chair back through a bolt and the threaded hole D.

Further, the chair seat is connected to the chair back through a support frame, and two ends of the support frame are respectively provided with threaded holes E.

Further, a front side of a top portion of a middle foot is provided with a bolt hole A, a rear side of the top portion of the middle foot is provided with a threaded hole E, and the middle foot is in bolted connection with the middle portion of the lower surface of the chair seat.

The present invention has the following beneficial effects after adopting the above technical solutions:

1. The present invention provides the easy-to-transport assembled sofa chair. According to the assembly sofa, the chair seat is split into two parts, the two parts are connected through a bolt, and a middle support leg is added for reinforcement and support, so that a structure is more stable; and the chair back is also split into two parts, the two parts are connected through a bolt, and a support frame is also added between the chair back and the chair seat, so that overall firmness of the sofa is enhanced. The chair seat and the chair back are split, so that a package size is reduced, thereby solving a problem that the sofa is inconvenient to transport and has high transportation costs due to a large overall size.

BRIEF DESCRIPTION OF THE DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Figure 1:
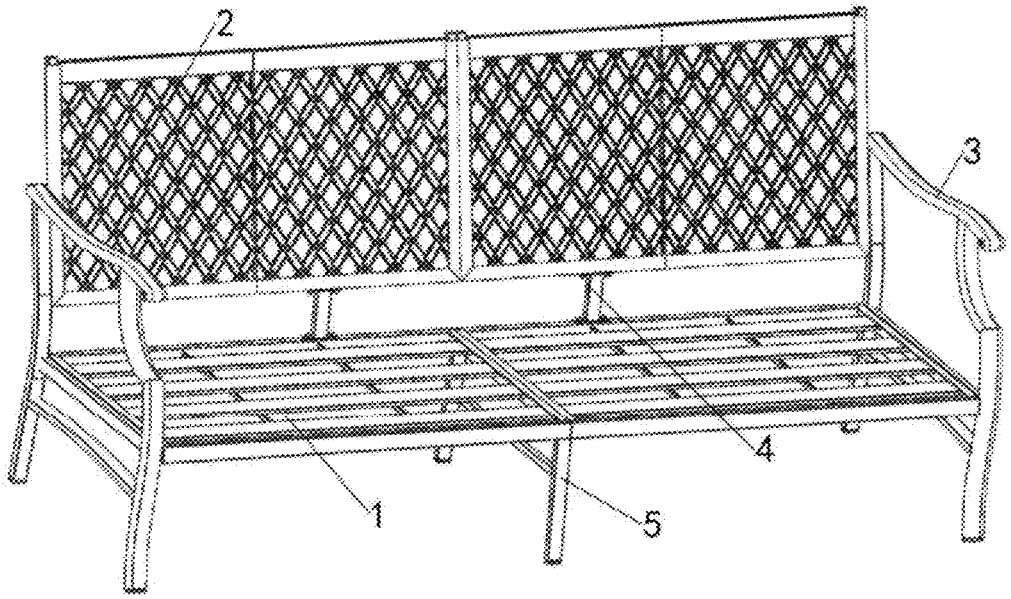
FIG. 1 is a schematic diagram of an overall structure of an easy-to-transport assembled sofa chair.

Reference numerals: 1. chair seat; 11. chair seat plate; 111. frame; 112. vertical beam; 113. transverse plate; 2. chair back; 21. chair back plate; 3. handrail frame; 31. handrail; 32. front leg; 33. rear leg; 34. cross bar; 4. support frame; 5. middle foot; 6. bolt hole A; 7. bolt hole B; 8. threaded hole C; 9. threaded hole D; 10. threaded hole E.

DETAILED DESCRIPTION OF THE EMBODIMENTS

An explicit and complete description of the technical solution in the present invention is given below in conjunction with the accompanying drawings. Apparently, the described embodiments are part of the embodiments of the present invention, not all of the embodiments. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Figure 2:
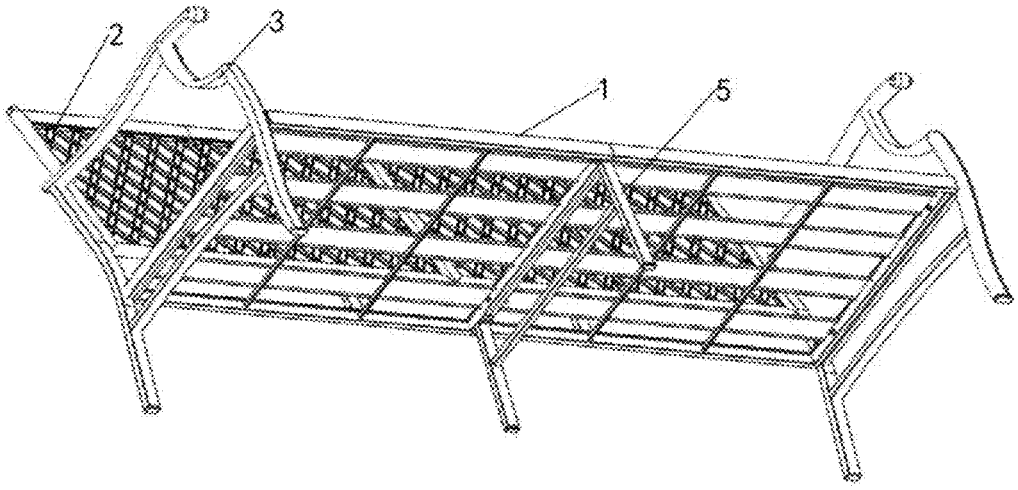
FIG. 2 is a schematic structural diagram of a bottom portion of an easy-to-transport assembled sofa chair.
Figure 3:
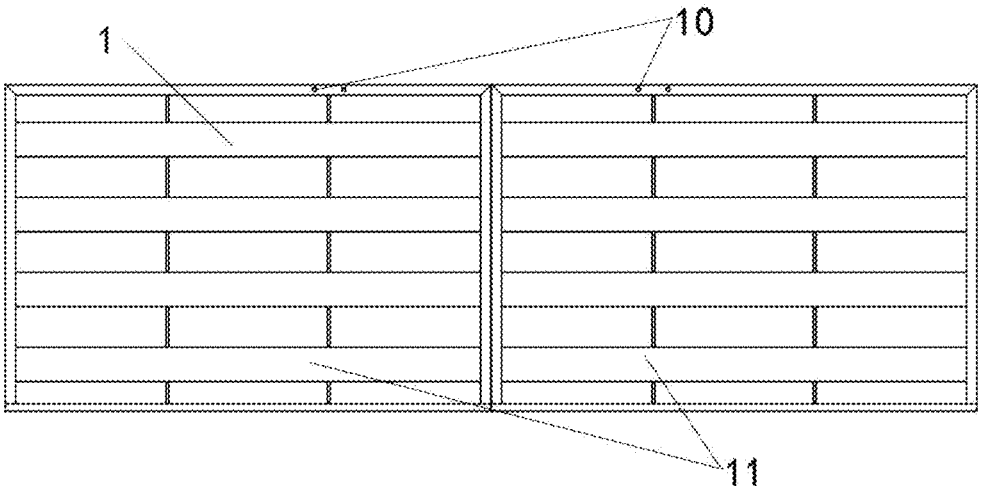
FIG. 3 is a schematic diagram of an overall structure of a chair seat in FIG. 1.
Figure 4:
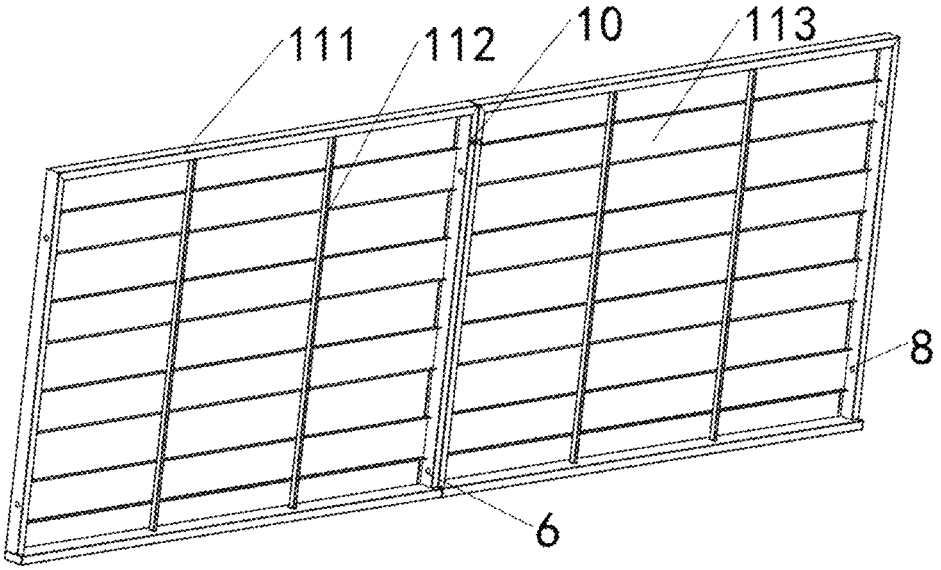
FIG. 4 is a schematic structural diagram of a bottom portion of a chair seat in FIG. 1.
Figure 5:
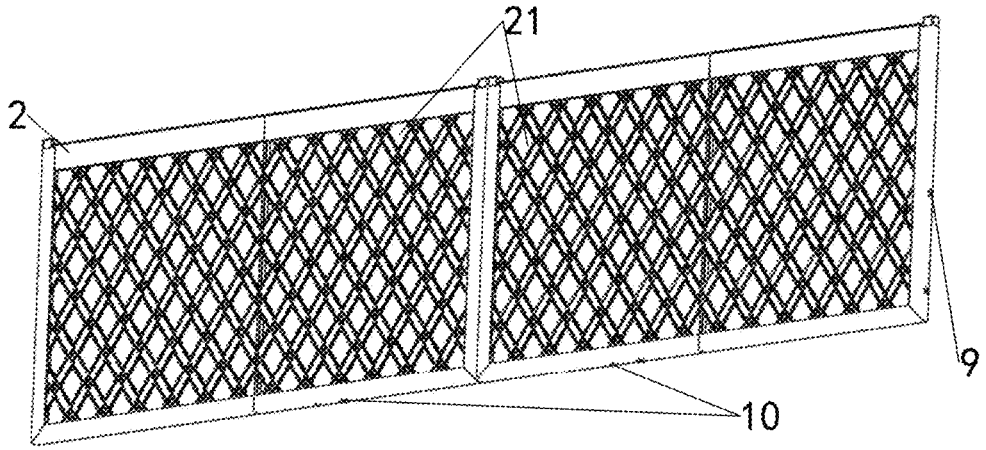
FIG. 5 is a schematic diagram of an overall structure of a chair back in FIG. 1.
Figure 6:
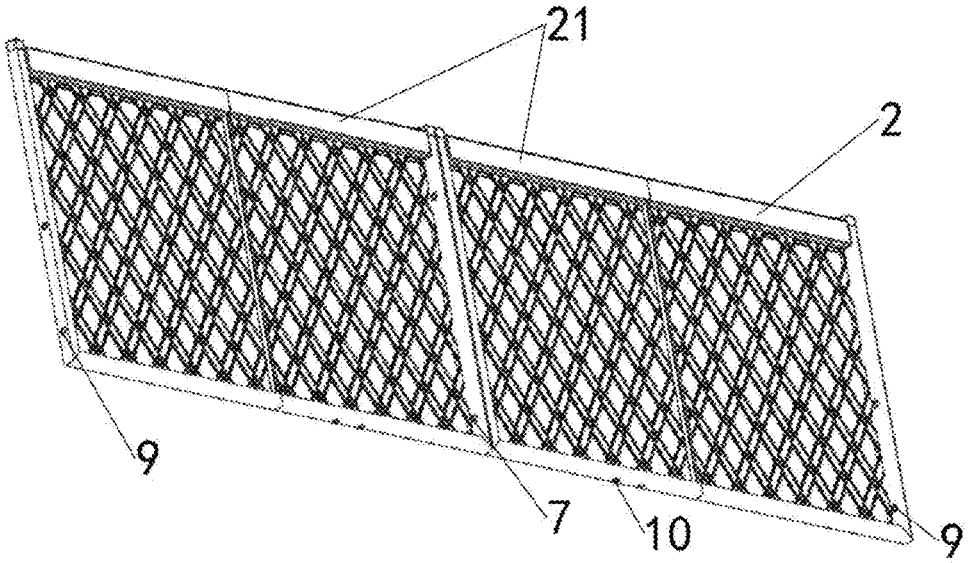
FIG. 6 is a schematic structural diagram of back portion of a chair back in FIG. 1.
Figure 7:
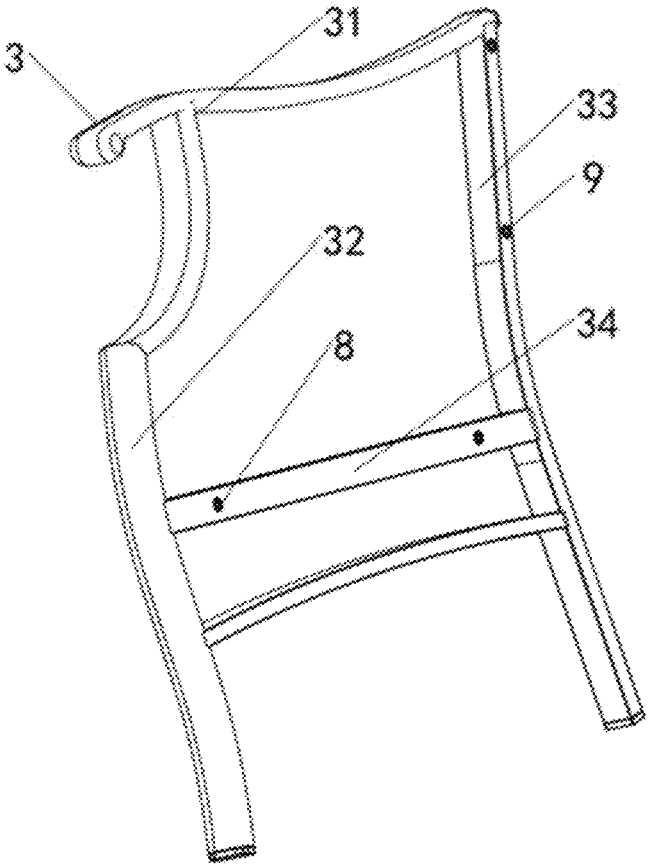
FIG. 7 is a schematic diagram of an overall structure of a handrail frame in FIG. 1.
Figure 8:
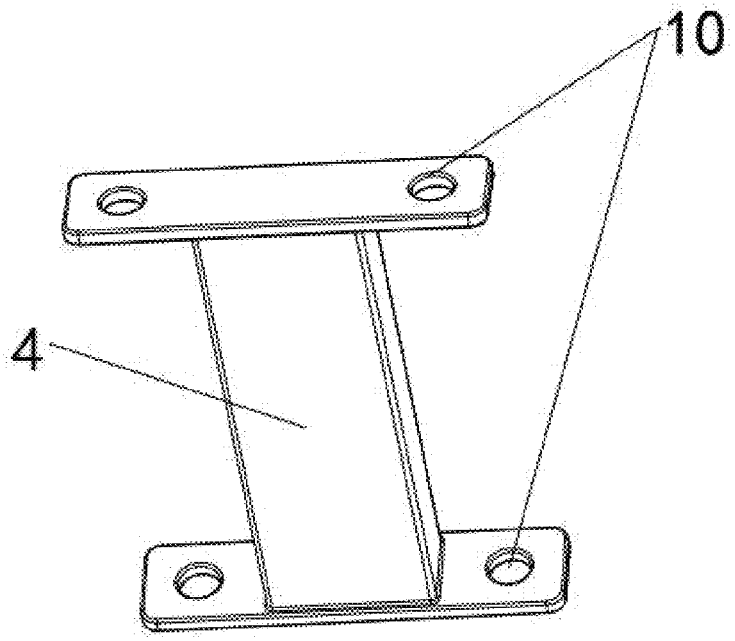
FIG. 8 is a schematic diagram of an overall structure of a support frame in FIG. 1.
Figure 9:
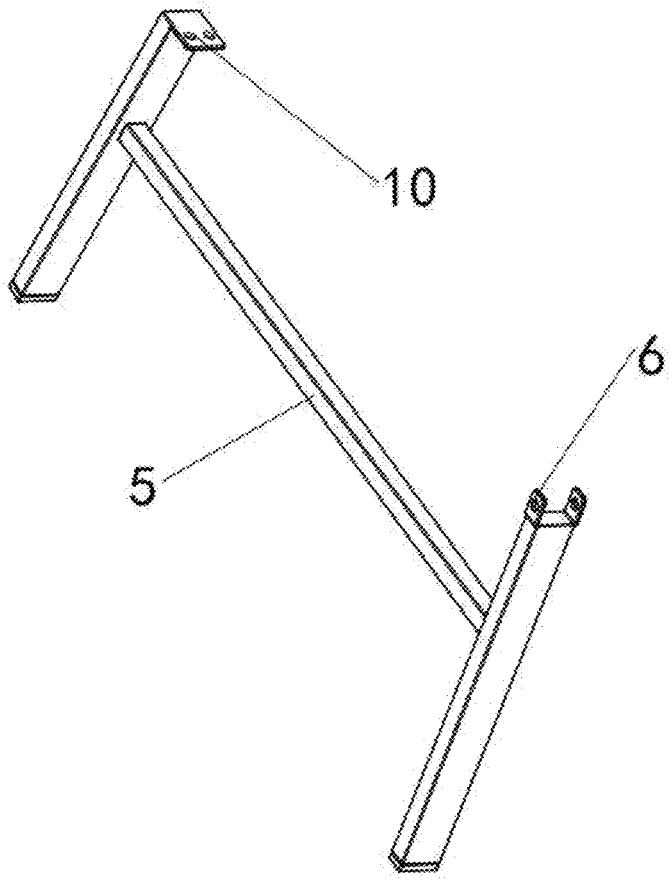
FIG. 9 is a schematic diagram of an overall structure of a middle support leg in FIG. 1.
Figure 10:
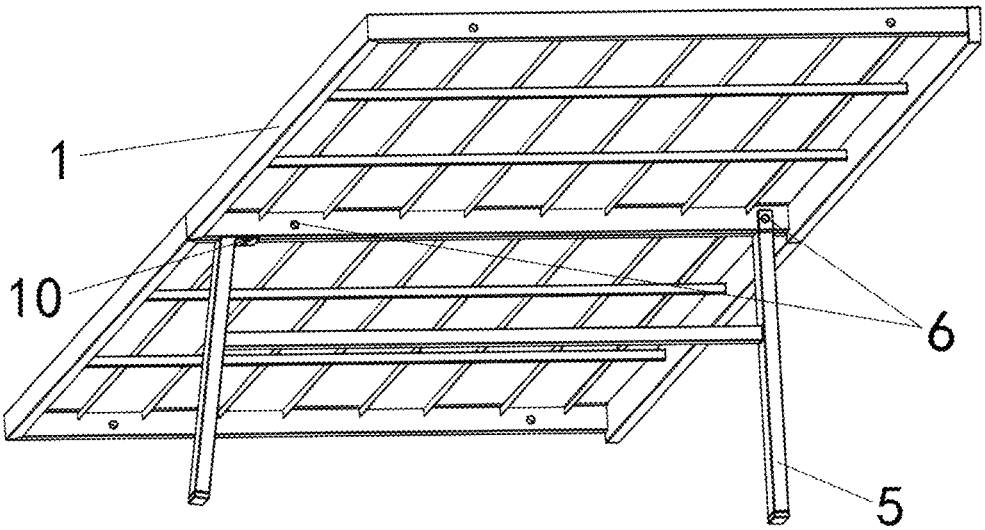
FIG. 10 is a schematic diagram of an overall structure of connection between a middle support leg and a chair seat in FIG. 1.

As shown in FIG. 1 to FIG. 10, an easy-to-transport assembled sofa chair provided in the embodiment includes a chair seat, where handrail frames 3 are respectively disposed on two sides of a body of the chair seat 1, a chair back 2 is disposed between the handrail frames 3, and the chair back 2 is located on a rear side of the chair seat 1; and the chair back 2 is formed by splicing two chair back plates 21, and the chair seat 1 is formed by splicing two chair seat plates 11. The chair seat is split into two parts, the two parts are connected through a bolt, and a middle support leg is added for reinforcement and support, so that a structure is more stable; and the chair back is also split into two parts, the two parts are connected through a bolt, and a support frame is also added between the chair back and the chair seat, so that overall firmness of the sofa chair is enhanced. The chair seat and the chair back are split, so that a problem that the sofa chair is inconvenient to transport due to a large overall size is solved.

In the embodiment, a splicing side edge of the chair seat plate 11 is provided with bolt holes A 6, and the two chair seat plates 11 are connected through bolts and the bolt holes A 6; and the two chair seat plates are matched with two M6*48 bolts to form the chair seat of the sofa, and one of the M6*48 bolts is connected to the two chair seat plates and a front side of a top portion of a middle foot simultaneously. Frames 111 are disposed around the chair seat plate 11, two side-by-side vertical beams 112 are disposed on a region encircled by the frames 111, two ends of the vertical beam 112 are welded to inner walls of the frames 111, a plurality of transverse plates 113 are uniformly arranged on an upper surface of the vertical beam 112, and two ends of the transverse plate 113 respectively abut against inner walls of the frames 111. The vertical beams and the transverse plates in the chair seat plate are arranged perpendicularly, and end portions are welded to the inner walls of the frames, so that a structure is stable, strength is high, and a bearing capacity is strong. A splicing side edge of the chair back plate 21 is provided with bolt holes B 7, and the two chair back plates 21 are connected through bolts and the bolt holes B 7. The two chair back plates are matched with two M6*52 bolts to form the chair back of the sofa. A cushion and a backrest are respectively placed on an upper portion of the chair seat and a front portion of the chair back, thereby improving overall comfort of the sofa chair.

In the embodiment, two side edges of the chair seat 1 are respectively provided with threaded holes C 8, and a rear portion of an upper surface of the chair seat 1 and a middle portion of a lower surface of the chair seat are respectively provided with threaded holes E 10. Two side edges of the chair back 2 are respectively provided with threaded holes D 9, and a bottom portion of the chair back 2 is provided with threaded holes E 10.

In the embodiment, a front leg 32 and a rear leg 33 are respectively welded at two ends of a lower surface of a handrail 31 in a body of the handrail frame 3, and a cross bar 34 is fixed between the front leg 32 and the rear leg 33. The front leg, the rear leg, and the handrail in the handrail frame are arc-shaped bar member, and the cross bar is a straight bar member and is disposed on a middle portion of the handrail frame. One connecting rod is disposed below the cross bar, and two ends of the connecting rod are respectively welded to side walls of the front leg and the rear leg for reinforcing the handrail frame. In two handrail frames, lower portions of the front legs and the rear legs jointly form four support legs of the sofa for supporting the sofa, thereby improving overall stability of the sofa.

In this embodiment, a side edge of the cross bar 34 is provided with threaded holes C 8, and the cross bar 34 is connected to a side edge of the chair seat 1 through bolts and the threaded holes C 8. The threaded holes C on the two side edges of the chair seat are adapted to the threaded holes C on the side edge of the cross bar, and the two side edges of the chair seat are respectively fitted with two M6*25 screws to be connected to the cross bar in the body of the handrail frame.

In this embodiment, an upper portion of a side edge of the rear leg 33 is provided with threaded holes D 9, and the rear leg 33 is connected to a side edge of the chair back 2 through bolts and the threaded holes D 9. The threaded holes D on two side edges of the chair back are adapted to the threaded holes D on the upper portion of the side edge of the rear leg, and the two side edges of the chair back are respectively fitted with two M6*30 screws to be connected to the rear leg in the body of the handrail frame.

In the embodiment, the chair seat 1 is connected to the chair back 2 through a support frame 4, and two ends of the support frame 4 are respectively provided with threaded holes E 10. The threaded holes E on a top portion of the support frame are adapted to the threaded holes E on the bottom portion of the chair back, and the threaded holes E on a bottom portion of the support frame are adapted to the threaded holes E on the rear portion of the upper surface of the chair seat. The two ends of the support frame are respectively connected to the chair seat and the chair back through bolts and the threaded holes E. Two groups of the support frames are disposed between the chair seat and the chair back, and a total of eight M6*18 screws are used for connection. The support frame is configured to connect the chair seat and the chair back and functions as reinforcement, thereby improving overall strength and stability of the sofa. The cushion and the backrest are respectively placed on the upper portion of the chair seat and the front portion of the chair back, thereby improving overall comfort of the sofa.

In the embodiment, a front side of a top portion of a middle foot 5 is provided with bolt holes A 6, a rear side of the top portion of the middle foot 5 is provided with threaded holes E 10, and the middle foot 5 is in bolted connection with the middle portion of the lower surface of the chair seat 1. The bolt holes A on the front side of the top portion of the middle foot are adapted to the bolt holes A on a front portion of the splicing side edge of the chair seat plate, and one M6*48 bolt is fitted; and the threaded holes E on the rear side of the top portion of the middle foot are adapted to the threaded holes E on the middle portion of the lower surface of the chair seat, and two M6*18 screws are fitted. The front side of the top portion of the middle foot is connected to the front side of the lower portion of the chair seat through one M6*48 bolt, and connection between the two chair seat plates is reinforced at the same time. The rear side of the top portion of the middle foot is connected to the rear side of the lower portion of the chair seat through two M6*18 screws. The middle foot is disposed at a joint between the two chair seat plates for reinforcing the chair seat, thereby improving overall strength of the sofa chair.

Finally, it should be noted that the above embodiments are only used to illustrate the technical solutions of the present invention rather than limiting thereto. Although the present invention has been described in detail with reference to the foregoing embodiments, those of ordinary skill in the art should understand that the technical solutions recited in the foregoing embodiments may still be modified, or some or all of the technical features thereof may be replaced with equivalents. These modifications or replacements do not make the essence of the corresponding technical solution deviate from the scope of the technical solutions in the embodiments of the present invention.

What is claimed is:

1. An easy-to-transport assembled sofa chair, comprising a chair seat (1), wherein handrail frames (3) are respectively disposed on two sides of a body of the chair seat (1), a chair back (2) is disposed between the handrail frames (3), and the chair back (2) is located on a rear side of the chair seat (1); and the chair back (2) is formed by splicing two chair back plates (21), and the chair seat (1) is formed by splicing two chair seat plates (11);

wherein a splicing side edge of the chair seat plate (11) is provided with a bolt hole A (6), and the two chair seat plates (11) are connected through a bolt and the bolt hole A (6); and frames (111) are disposed around the chair seat plate (11), two side-by-side vertical beams (112) are disposed on a region encircled by the frames (111), two ends of the vertical beam (112) are welded to inner walls of the frames (111), a plurality of transverse plates (113) are uniformly arranged on an upper surface of the vertical beam (112), and two ends of the transverse plate (113) respectively abut against inner walls of the frames (111).

2. The easy-to-transport assembled sofa chair according to claim 1, wherein two side edges of the chair seat (1) are respectively provided with threaded holes C (8), and a rear portion of an upper surface of the chair seat (1) and a middle portion of a lower surface of the chair seat are respectively provided with threaded holes E (10).

3. The easy-to-transport assembled sofa chair according to claim 2, wherein the chair seat (1) is connected to the chair back (2) through a plurality of support frames (4), and two ends of the support frame (4) are respectively provided with threaded holes E (10).

4. The easy-to-transport assembled sofa chair according to claim 2, wherein a front side of a top portion of a middle foot (5) is provided with a bolt hole A (6), a rear side of the top portion of the middle foot (5) is provided with a threaded hole E (10), and the middle foot (5) is in bolted connection with the middle portion of the lower surface of the chair seat (1).

5. The easy-to-transport assembled sofa chair according to claim 1, wherein a splicing side edge of the chair back plate (21) is provided with a bolt hole B (7), and the two chair back plates (21) are connected through a bolt and the bolt hole B (7).

6. The easy-to-transport assembled sofa chair according to claim 1, wherein two side edges of the chair back (2) are respectively provided with threaded holes D (9), and a bottom portion of the chair back (2) is provided with a threaded hole E (10).

7. The easy-to-transport assembled sofa chair according to claim 1, wherein a front leg (32) and a rear leg (33) are respectively welded at two ends of a lower surface of a handrail (31) in a body of the handrail frame (3), and a cross bar (34) is fixed between the front leg (32) and the rear leg (33).

8. The easy-to-transport assembled sofa chair according to claim 7, wherein a side edge of the cross bar (34) is provided with a threaded hole C (8), and the cross bar (34) is connected to a side edge of the chair seat (1) through the threaded hole C (8).

9. The easy-to-transport assembled sofa chair according to claim 7, wherein an upper portion of a side edge of the rear leg (33) is provided with a threaded hole D (9), and the rear leg (33) is connected and fixed to a side edge of the chair back (2) through the threaded hole D (9).

* * * * *